US005305830A

United States Patent [19]

Wittrisch

[11] Patent Number: 5,305,830

[45] Date of Patent: Apr. 26, 1994

[54] METHOD AND DEVICE FOR CARRYING OUT MEASURINGS AND/OR SERVICINGS IN A WELLBORE OR A WELL IN THE PROCESS OF BEING DRILLED

[75] Inventor: Christian Wittrisch, Rueil-Malmaison, France

[73] Assignee: Institut Francais du Petrole, Rueil Malmaison Cedex, France

[21] Appl. No.: 923,559

[22] Filed: Aug. 3, 1992

[30] Foreign Application Priority Data

Aug. 2, 1991 [FR] France ..... 9109915

[51] Int. Cl.[5] ..... E21B 47/00

[52] U.S. Cl. ..... 166/250; 166/385; 175/50; 73/151

[58] Field of Search ..... 166/250, 254, 255, 380, 166/385; 175/45, 50; 73/151

[56] References Cited

U.S. PATENT DOCUMENTS

| | | | |
|---|---|---|---|
| 4,126,848 | 11/1978 | Denison | 340/18 LD |
| 4,325,438 | 4/1982 | Zuvela | 175/50 |
| 4,349,072 | 9/1982 | Escaron et al. | 166/250 |
| 4,664,189 | 5/1987 | Wittrisch | 166/250 |
| 4,690,214 | 9/1987 | Wittrisch | 166/65.1 X |
| 5,180,011 | 1/1993 | Wittrisch | 166/250 |
| 5,207,096 | 5/1993 | Castel et al. | 166/250 X |
| 5,217,072 | 6/1993 | Wittrisch | 166/250 |

FOREIGN PATENT DOCUMENTS

| | | |
|---|---|---|
| 2501777 | 9/1982 | France . |
| 0404669 | 12/1990 | France . |
| 1557863 | 12/1979 | United Kingdom . |

*Primary Examiner*—Terry Lee Melius

*Attorney, Agent, or Firm*—Antonelli, Terry, Stout & Kraus

[57] ABSTRACT

A method and a device for carrying out measurings and/or servicings in a wellbore or a well in the process of being drilled by means of electric connection linking the surface to an assembly fastened to the end of a drill string involve the use of an assembly comprising measuring and/or servicing means linked to a first connector integral with the assembly; a cable section comprising at the lower end thereof, a second connector and at the upper end thereof, a first intermediate connector integral with a support; and a cable linked to the surface comprising at the lower end thereof a second intermediate connector.

17 Claims, 7 Drawing Sheets

METHOD AND DEVICE FOR CARRYING OUT MEASURINGS AND/OR SERVICINGS IN A WELLBORE OR A WELL IN THE PROCESS OF BEING DRILLED

FIELD OF THE INVENTION

The present invention relates to a method and a device for carrying out measurings and/or servicings in a wellbore or in a well in the process of being drilled by means of an electric connection linking the surface to an assembly fastened to the end of a drill string. Said assembly comprises measuring and/or servicing means electrically linked to a first connector fastened to the lower part of the first pipe.

The electric connection comprises a cable section having at the lower end thereof a second connector adapted for co-operating electrically with the first connector and at the upper part thereof a first intermediate connector integral with a support, a second intermediate connector adapted for co-operating electrically with the first intermediate connector, said second intermediate connector being fastened to a cable connected with the surface.

BACKGROUND OF THE INVENTION

Patent FR-2,501,777 mentions a known method and device for carrying out measurings and/or servicings from a sonde fastened to the end of a drill string, but this document only relates to logging devices and has no intermediate connectors. The rotating of the whole of the string in the well is impossible when the sonde is connected because of the presence of the cable coaxial with respect to the drill string or annular when a side-entry sub is used.

The present invention allows to connect measuring and/or servicing means notably included in a drilling assembly and allows the rotating of the whole of the string without requiring the total coaxial cable to be taken up to the surface, by means of intermediate connectors and of an adapted support.

Document GB-1,557,863 mentions a known method and device for transmitting information coming from a sonde lowered in a drill string, said sonde being suspended to a cable section, said section being linked to the surface by means of a connector and of a cable. The sonde is lowered into the string at the end of the cable and must therefore have an outside diameter compatible with the inner passage of the tubular string, and the hanging of the section is achieved at the surface.

The present invention advantageously allows a size of measuring devices which no longer depends on the inside diameter of the drill string channel. In fact, in small drilling sizes, it is sometimes impossible to have certain equipments. The invention integrates the measuring and/or servicing means in housings which may have the outside dimension of the drill collars conventionally used in the borehole considered. The electronic elements are linked to the surface by a device comprising at least one double couple of electric connectors. Operating the pipes so as to take them down or up can be easily done by taking up a limited cable length, which only requires a very short time and allows high capacity transmissions by means of a cable transmission. No cable in the annulus, as it is commonly the case in this field when a side-entry sub is utilized, is advantageous when safety imposes an annular seal at the wellhead, either continuously in case of air drilling or foam drilling, or occasionally when the bottomhole pressure is unbalanced. In these cases, the cable is bothersome and sometimes dangerous.

In certain strongly deflected wellbores, notably those with a small bending radius, this invention is economically very interesting for the phase of control of the trajectory of the wellbore in the curve and in the substantially horizontal part. In fact, the tools used in the prior art use notably a transmission by pressure waves in the fluid so as to be able to rotate the total string without the cable being in the way or having to be taken up completely. With the invention, the length of the section may correspond to the kick-off point, and since the length of the wellbore with a small bending radius is limited to several hundred meters, maneuvering the cable connected to the surface is simple and fast during the total deflection phase. With the invention, the frequency of the measurings and servicings is thus comparable to what can be obtained with transmissions without an electric cable, and moreover with a lesser cost and complexity. Moreover, rotating the total string is allowed when the cable has been taken up to the surface.

In the case of very deep and therefore very high temperature drilling, the invention will be advantageously applied because it provides a mechanical support for taking up the weight of the cable and the tensile strains generated on the cable notably through an energetic circulation of a cooling fluid. In fact, in deep drillings, the tension which a continuous cable would withstand is higher than the allowable tension. The solution therefore consists in having intermediate supports of sections with an acceptable length.

SUMMARY OF THE INVENTION

The present invention thus relates to a method for carrying out measuring and/or servicings in a wellbore or a well in the process of being drilled and comprising the following stages:

a) fastening to the end of a first pipe of a drill string an assembly comprising measuring and/or servicing means, said means being electrically linked to a first electric connector integral with said assembly and accessible from the inside of the drill string, b) assembling the drill string by connecting end to end new drillpipes above said first pipe and lowering progressively into the well said assembly and the drill string, as the latter is assembled, c) introducing into said drill string, from the surface, a second electric connector adapted for connecting onto the first connector, this second connector being mechanically fastened to the lower end of a cable section of non zero length comprising electric conductors and whose other end is fastened to a support adapted for being integral with said drill string and comprising a first intermediate electric connector, d) introducing into said drill string, from the surface, a second intermediate electric connector adapted for connecting onto said first intermediate connector, this second intermediate electric connector being mechanically fastened to the lower end of a cable comprising electric conductors and electrically linked to the surface, e) connecting said second connector to the first connector, f) making said support of the first intermediate connector integral with said drill string, g) connecting said second intermediate connector to the first intermediate connector, h) carrying out the measurings and/or servicings, i) disconnecting the second intermediate connector and taking it up to the surface by means of the cable.

In the method, stage a), then b) can be performed until the length of the drill string substantially corresponds to the length of said section and stages c), e) and f) can be performed thereafter, said support being located substantially at the surface.

Stages a), b), c) and g) may also be performed successively, the latter stage being achieved at the surface, then stage d) with said section connected to said cable by said intermediate connectors, stage e) and stage f).

The support may hold said section substantially taut.

Said section may be taken up to the surface, through said drill string, either by using said cable, or by means of a fishing tool adapted for connecting to the upper end of said section.

The second intermediate connector and the cable may be introduced into the drill string through a special side-entry sub.

Said assembly may comprise directional drilling means, notably a drill bit, a downhole motor, deflecting tools, location sensors. The location parameters of the device can be received and said drilling means may be optionally controlled through the electric linking means from the surface.

The invention further relates to a device for carrying out measurings and/or servicings in a wellbore or a well in the process of being drilled, comprising in combination:

an assembly fastened to a first pipe and comprising measuring and/or servicing means, a first electric connector integral with said assembly and accessible from the inside of the drill string, said connector being electrically linked to said means, a drill string connecting to the upper part of said pipe, a cable section of non zero length comprising electric conductors and having at the lower end thereof a second connector adapted for connecting to said first connector and a first intermediate connector at the other end thereof, said first intermediate connector being accessible from the inside of the drill string, a support of said first intermediate connector adapted for being integral with said drill string, and a cable extending up to the surface, comprising electric conductors and at the end of which a second intermediate connector adapted for connecting to the first intermediate connector is fastened.

Said support may be adapted for being made integral with said drill string when it is located substantially at the surface.

Similarly, said support may be adapted for being made integral with said drill string by remote control from the surface.

Said support may be adapted for holding said section substantially taut and the second connectors may be anchored on the first connectors.

At least one of said second connectors may be equipped with weights such as load bars and/or a system adapted to pumping so as to allow respectively the connection by gravity or by pumping of the second connector to the first one.

The outlet of the cable from the inside of the drill string may comprise a sealing means around the cable adapted for letting said cable slide in the drill string.

Said cable may pass through a side-entry sub and come out outside the drill string.

Said section may be adapted for being taken up to the surface either through said cable connected by the second intermediate connector, or through a fishing tool adapted for connecting onto the upper end of said section.

Said assembly may comprise a drill bit, a downhole motor, deflecting tools, location sensors, and the possible measurings and controls may pass through the electric connection.

The method and the device may be advantageously applied to the recording of measurements and/or to selective servicings in an oil well, while having the possibility of adding strings and/or of rotating said assembly and the drill string between each measuring and/or servicing.

BRIEF DESCRIPTION OF THE DRAWINGS

Other features and advantages of the present invention will be clear from reading the description hereafter of non limitative examples, with reference to the accompanying drawings in which.

DESCRIPTION OF THE PREFERRED EMBODIMENTS

Figure 1:
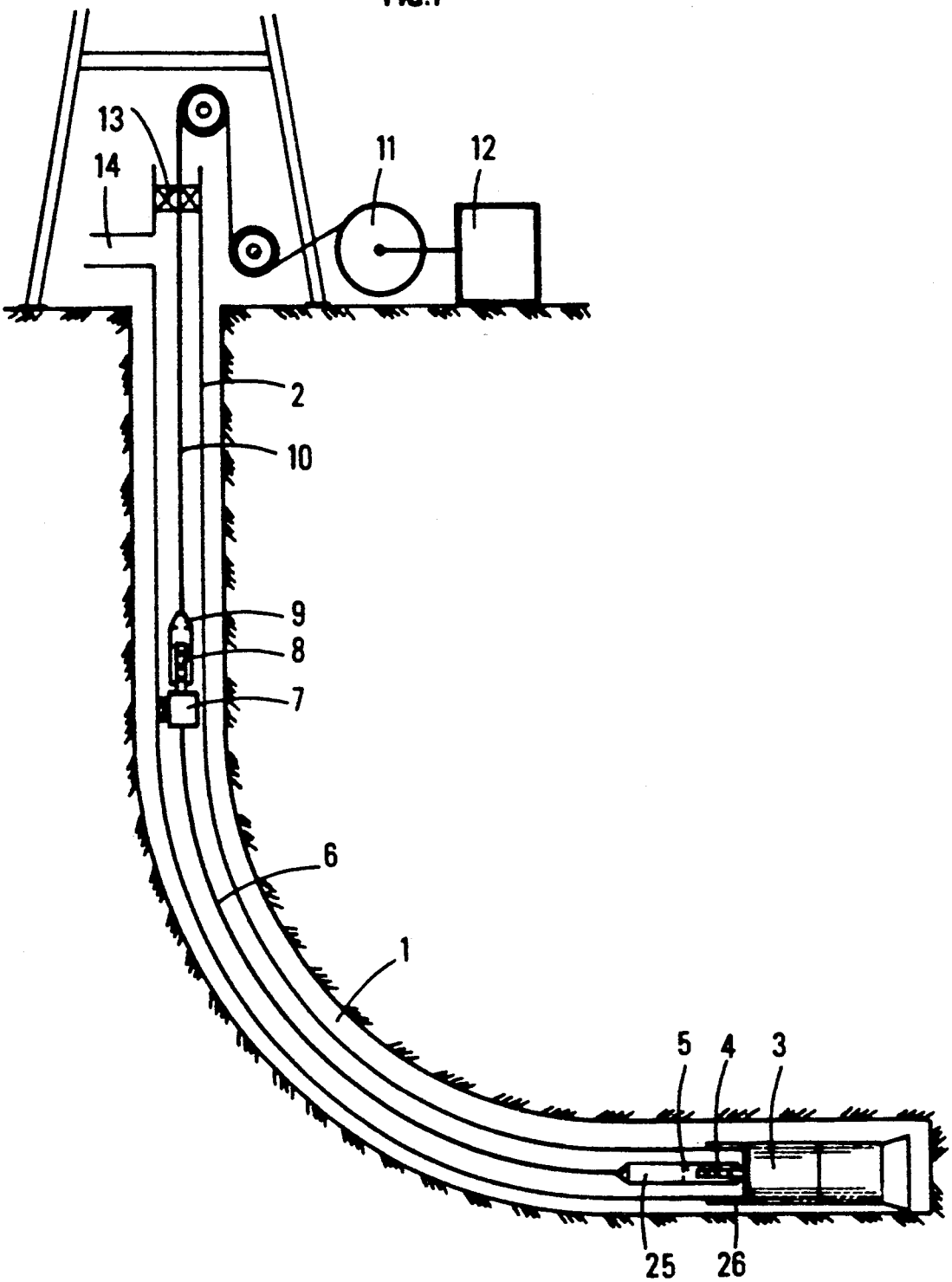
FIG. 1 shows a drilling assembly fastened to the end of a drill string and linked to the surface through an electric connection.

FIG. 1 shows a wellbore 1 in which a drill string 2 is located and at the end of which an assembly 3 comprising a first connector 4 integral with said assembly 3 is assembled. The assembly comprises measuring and servicing means electrically linked to the first connector 4.

A second connector 5 connected to connector 4 is mechanically fastened to the lower end of a cable section 6 comprising electric conductors. The upper end of this section comprises a first intermediate connector 8 integral with a support 7 which bonds this first intermediate connector in the inner channel of the drill string. The connection of connectors 4 and 5 is locked by a mechanical system which will be described hereafter.

A second intermediate connector 9 fastened to the end of a cable 10 is connected onto the first intermediate connector. Cable 10 comprises electric conductors, comes out through the upper end of the drill string and passes on pulleys before being wound round a winch 11. The electric conductors of this cable are connected to an electric joint rotating around the axis of the winch drum so as to be linked to a control cab 12.

A circulating head, fastened to the upper end of the drill string, is equipped with the conduit 14 allowing to pump the drilling fluid in the inner channel of the drill string, to feed the downhole motor intended to run the drill bit, to pump the connectors and to clear the annulus of the cuttings. The circulating head comprises an annular seal 13 adapted to cable 10. This head is well-known in the prior art. In the configuration of FIG. 1, the measuring and servicing means are thus electrically linked to the surface by the two couples of connectors, cable section 6 and cable 10. It is thus possible to operate practically over the length of the pipes located above the drill floor while taking measurements.

Without departing from the scope of this invention, the upper end of the drill string may be a kelly topped by the conventional swivel but equipped with a sealing means 13 at the outlet of and around cable 10, also if a power swivel replacing both the kelly and the swivel is used, said power swivel comprising of course the sealing means 13 around the cable.

In the invention, the assembly 3 comprising a connector 4 may notably be made up of:

logging tools, formation testing tools, such as a DST device comprising a packer, a valve on the drill string channel and pressure sensors, sampling tools such as a RFT marketed by Schlumberger, tools for carrying out measurings and servicings on the equipments of wells in production, perforating tools, tools with or without a downhole motor for redrilling packers, valves, etc, drilling means with or without a downhole motor and comprising measuring and/or servicing means, notably sensors for locating said assembly.

All these assemblies are linked to the surface through the electric connection and afford the advantage of having the possibility of direct transmission or control.

In the case of a drilling assembly comprising a drill bit, possibly a downhole motor, location sensors, it may be advantageous to have deflecting tools as a bent sub and variable geometry stabilizer which may be controlled by means of the electric connection going up to the surface.

Figure 1A:
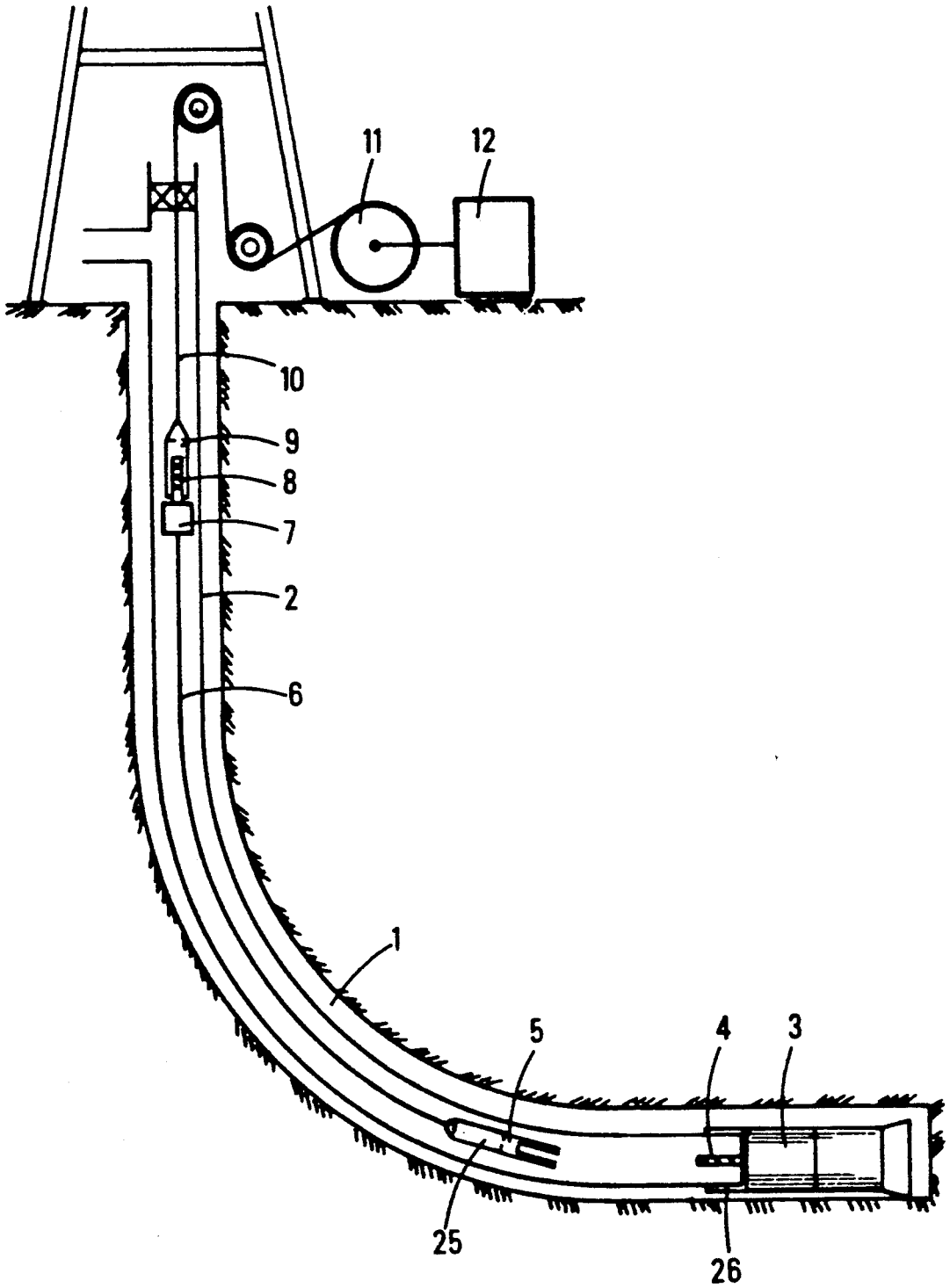
FIG. 1A shows the assembly before the connection.

The support 7 of the first intermediate connector 8 is integral with the drill string, in accordance with the following two functional principles:

1) it is either arranged substantially close to the surface (FIG. 2), which means that, in this case, the length of the drill string corresponds substantially to the length of cable section 6, 2) or the drill string is assembled down to the point where the electric link is required for connecting said assembly. The cable section 6 connected to cable 10 (FIG. 1A) through the connection of intermediate connectors 8 and 9 is then lowered into the inner channel of the pipes. Connectors 4 and 5 are connected thereby and support 7 is made integral with the inner channel of the drill string by remote control.

Figure 2:
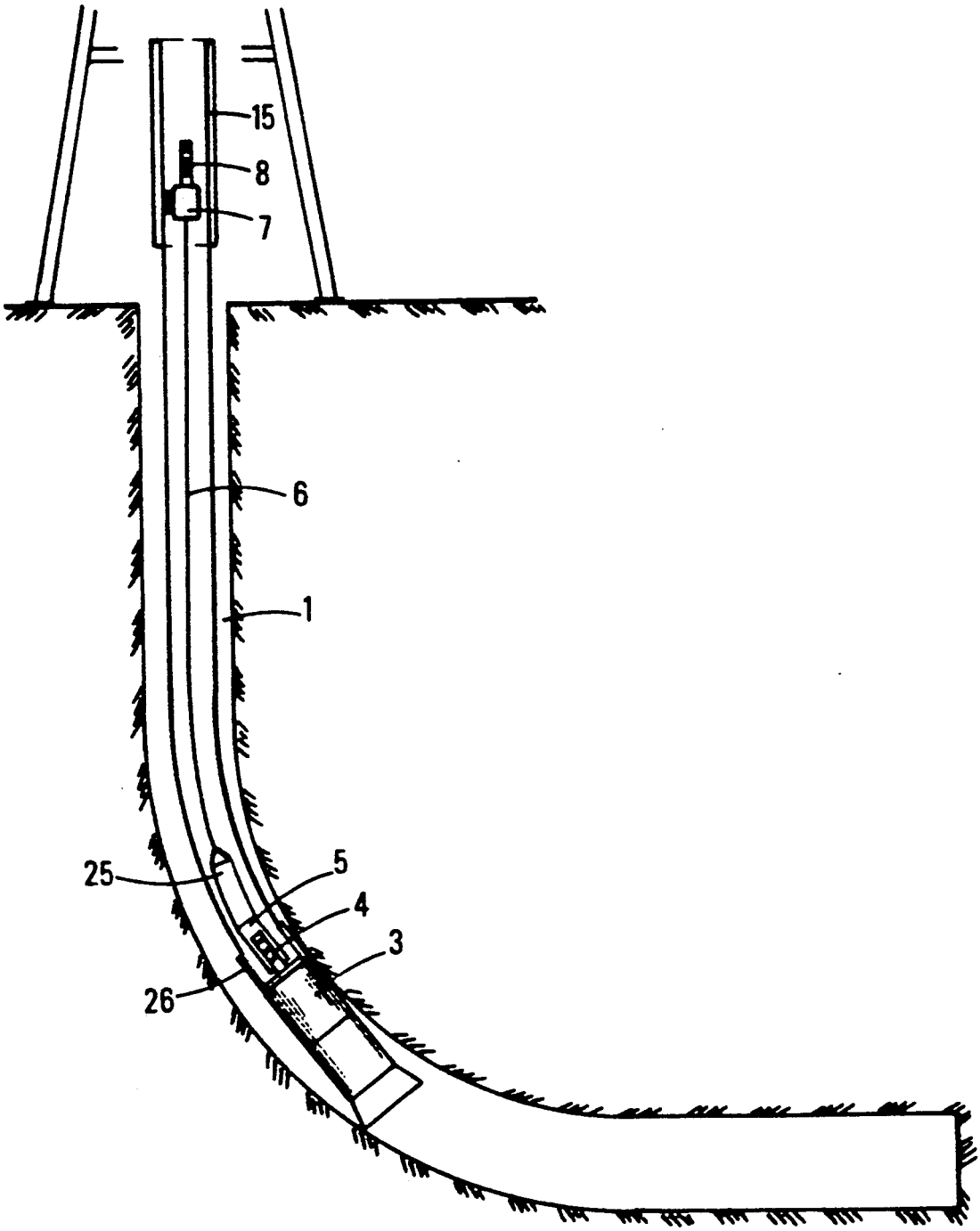
FIG. 2 shows another stage of the connection.
Figure 3:
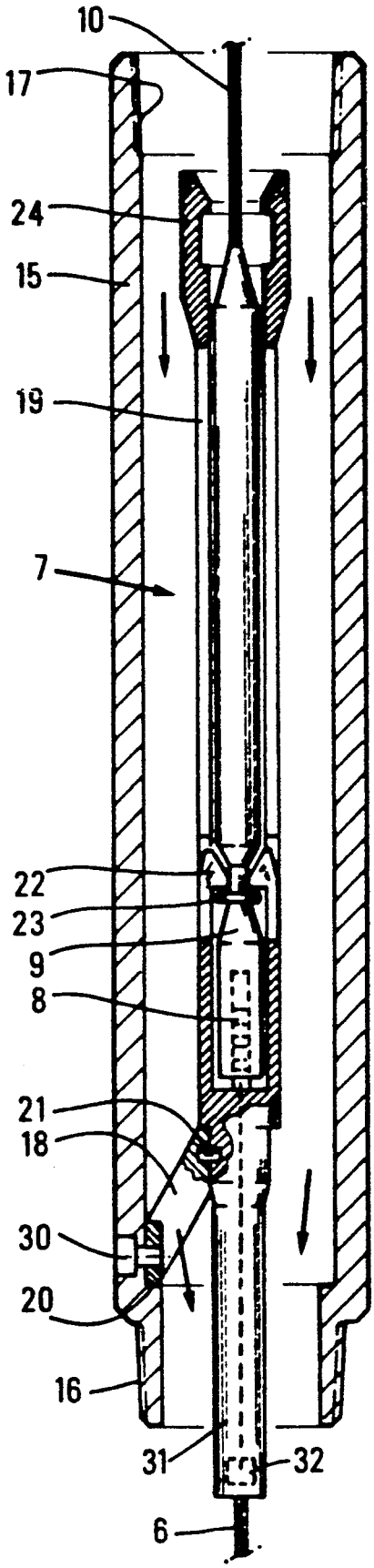
FIG. 3 shows one embodiment of the support of the intermediate connectors.

In the first case, operations begin by lowering into wellbore 1 assembly 3 and the first connector 4 thereof at the end of a length of drill string (FIG. 2). When said assembly has reached a determined depth, for example in drilling when the bottom is close, a sub 15 is screwed onto the top of the pipes and cable section 6 is constituted as follows: the second connector 5 is mechanically fastened to the end of a cable length wound round a logging winch, this cable is lowered into the drill string and connectors 4 and 5 are connected either by gravity or by pumping, as described in patent FR-2,501,777, the weight of the cable is held up by collars above sub 15, the cable is cut substantially above the sub and the first intermediate connector is mechanically fastened to the upper end of the section (FIG. 3).

The first intermediate connector is integral with a support 7 comprising a sleeve 19, said support being thereafter made integral with sub 15.

Another operating procedure may also be followed for constituting section 6: before screwing sub 15, connector 5 is lowered into the drill string at the end of a cable and by means of a winch. The cable is cut and supported at the level of the upper pipe, then cable section 6 is mechanically fastened and electrically linked to the connector 8 integral with sleeve 19, which has already been set in sub 15. The assembly consisting of sub 15, sleeve 19 and section 6 is taken up by means of a winch and of thread 17, then thread 16 is screwed onto the upper pipe of the drill string.

Of course, once section 6 has been constituted and equipped with these connectors, it may be used for another drilling. The length of the drill string will be adapted to the length of said section. The same pipes will generally be used so as to obtain the same length for the drill string.

Figure 2A:
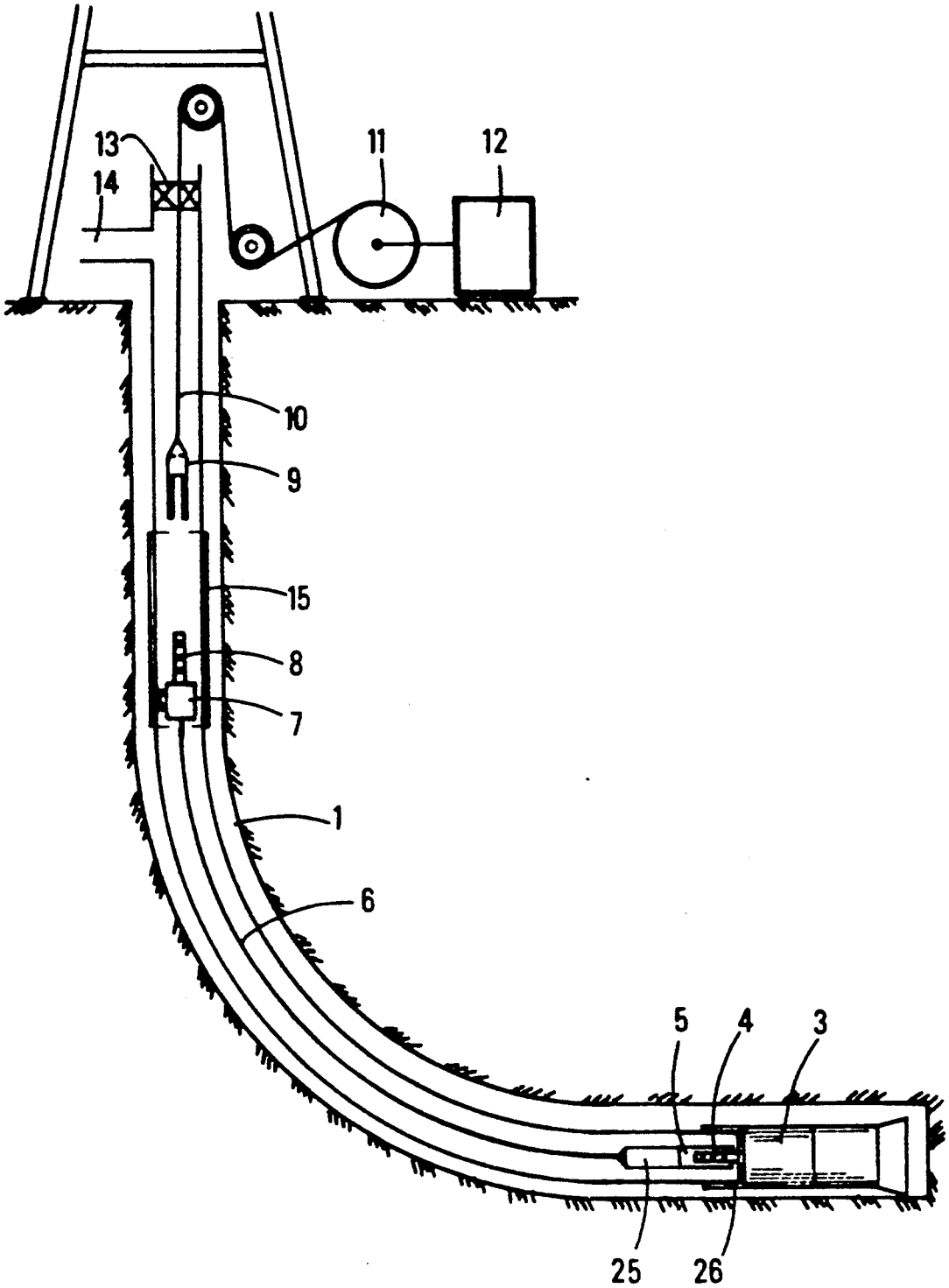
FIG. 2A shows the stage preceding the connection of the intermediate connector.

Above said sub 15, other pipes are assembled so as to follow the displacement of assembly 3. When assembly 3 is to be electrically linked to the surface, the second intermediate connector 9 is connected to the first intermediate connector 8. FIG. 2A shows this connection which is achieved with the same techniques as for connectors 4 and 5. Each time an operation which is made impossible through the presence of coaxial cable 10 is to be carried out, the second intermediate connector 9 just has to be disanchored, cable 10 is taken up to the surface and operations may begin. It is thus notably possible to add pipes in a conventional way so as to deepen the wellbore, to rotate the whole of the drill stem from a surface rotating means such as a rotary table or a power swivel.

Of course, the displacements may be performed upon taking down as well as upon taking up the drill string.

FIG. 3 shows an embodiment of a system of sub and support 7 of the first intermediate connector 8. Cable section 6 is mechanically fixed to connector 8 through a stop 32. The conductors of cable 6 are linked to connector 8 through conductors 31. A sub 15 comprises lower 16 and upper means 17 for fastening to said drill string. Suspension arms 18 lock the axial displacement towards the bottom of a sleeve 19 by co-operating with a shoulder 20 of sub 15. Arms 18 are adapted for letting the fluid circulate freely in the annulus thus created by the outside of sleeve 19 and the inside of said sub 15. The arms are integral with sub 15 through means 30. A locking means 21, consisting for example of at least one shearable screw, makes sub 15 integral with sleeve 19 by means of arms 18. The first intermediate connector 8 is integral with sleeve 19. A traction exerted on the sleeve and higher than the shear strength of screw 21 releases the sleeve upwards by allowing the taking up of the sleeve, of the first intermediate connector and of section 6. This example is not limitative, sleeve 19 may also be fitted with locking fingers remote controlled from the surface as locking means 21. The second intermediate connector 9 connected to the first one is locked by means of fingers 22 integral with the sleeve, said fingers co-operating with a holding part 23 integral with the second intermediate connector. This holding part 23 may release the second conductor when the part is broken or may be moved aside by remote controlling from the surface a motor means located above intermediate connector 9. The upper end of sleeve 19 comprises a device 24 adapted for co-operating with an overshot (not shown here) lowered inside the drill string so as to fish up the sleeve, the first intermediate connector thereof and the whole of cable section 6. An overshot may also be fixed to sleeve 19 by means of fingers 22.

Without departing from the scope of this invention, support 7 may co-operate directly with the means for connecting the pipes with one another, such as pin-to-box subs, without adding any intermediate sub 15. Arms 18 just have to be adapted for being integral with the pipes when the box and pin threads are screwed onto one another.

In the second case (FIG. 1A), the connection between the intermediate connectors is performed at the surface and connector 5, section 6, support 7 and the connector 8 thereof connected to connector 9 are taken down together inside the drill string by means of cable 10 and winch 11. The connection of connectors 4 and 5 is achieved as described above. Support 7 is made integral with the drill string by remote control. The embodiment of support 7 is shown in FIGS. 4A and 4B.

Figure 4A:
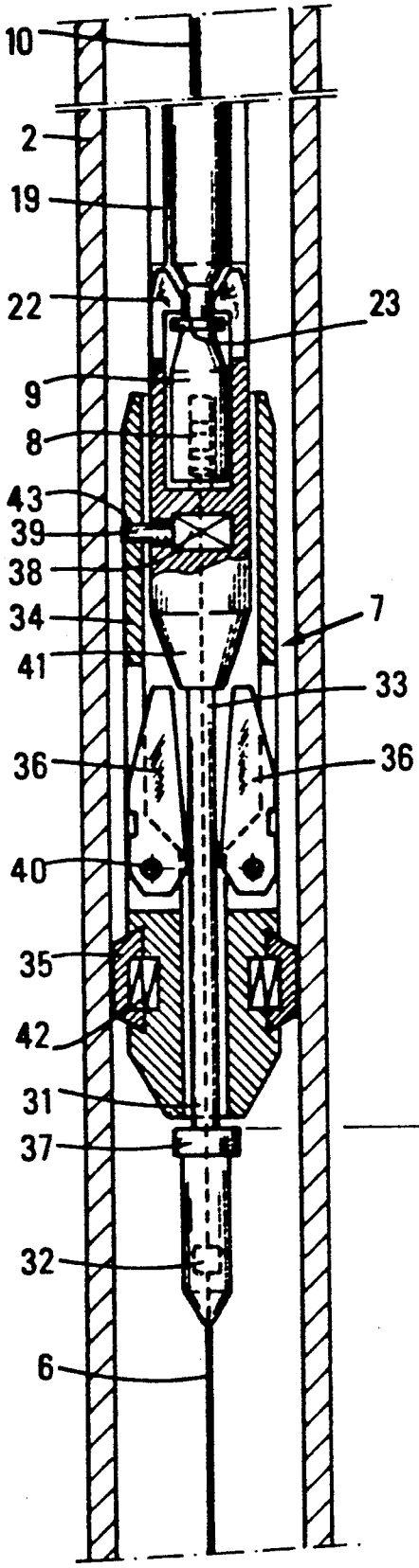
FIGS. 4A and 4B show another embodiment of the support of the intermediate connectors.
Figure 4B:
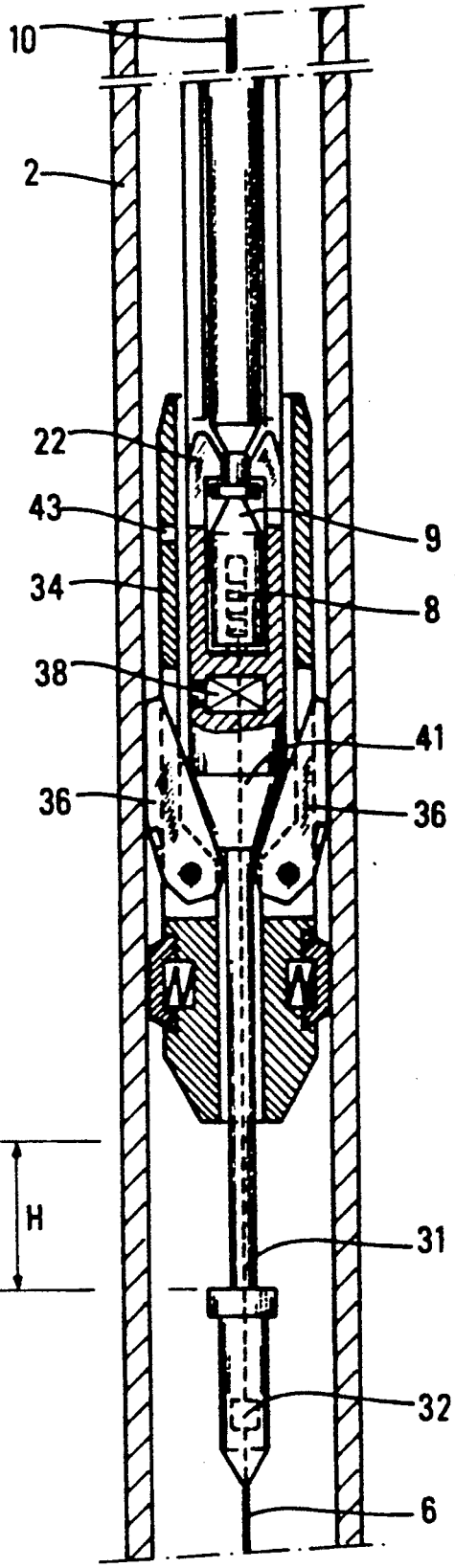

In FIG. 4A, support 7 is shown in the state in which it is lowered in line 2. It comprises a first connector 8 integral with a sleeve 19. Sleeve 19 is identical to that which is described in FIG. 3. Sleeve 19 is integral with a shaft 33 at the end of which cable section 6 is fastened by means of a stop 32. Conductors 31 link electrically the conductors of cable section 6 to intermediate connector 8. A body 34 comprising friction pads 35 and anchoring wedges 36 is arranged around shaft 33. The lower end of this body rests on a shoulder 37 integral with shaft 33. Body 34 is locked in a position of rest on shoulder 37 through the co-operating of a finger 39 of a locking system 38 integral with the shaft and of a hole 43 in body 34. Each anchoring wedge 36 can rotate round an axis 40 perpendicular to the longitudinal axis of the support. Springs (not shown) hold the wedges closed around the shaft. A means 41 for expanding the anchoring wedges is integral with the shaft. The friction pads 35 are radially pushed by springs 42. These springs 42 provide the contact force necessary between the line and the pads to have a sufficient longitudinal friction; besides, they allow the pads to retract upon the passing of sections of limited diameter at the level of the connections of the tubulars.

The support 7 of section 6 is connected to the surface through cable 10 equipped at the lower end thereof with the second intermediate connector 9. The locking of this connector 9 is achieved through the co-operating of fingers 22 and of a holding part 23 integral with the second connector 9.

The locking system 38 is controlled electrically from the surface by means of cable 10 linked to the shaft through the two connectors. It is advantageous for this lock to be reversible, that is that it may be unlocked or locked by remote control, notably from cable 10. Such a lock is well-known and may notably be achieved by means of motor means acting upon finger 39. But, in this invention, an unlocking system actuated through the break of finger 39, notably by explosive, will be sufficient in some cases. In another embodiment, the wedges may be integral with the shaft, while the expansion means is integral with the body.

FIG. 4B shows said support anchored in line 2. The locking system 38 has been controlled so as to be unlocked and then, by means of cable 10, the shaft is made to slide over a distance H. The relative sliding between the shaft and the body is obtained by means of the friction pads which hold body 34 substantially fixed in relation to the line and through the action of a force displacing the shaft downwards. This force may be notably provided by the weight of the shaft, the weight of the ballast integral with the second connector 9, the weight of section 6 and/or the tension applied onto section 6 when the end thereof is anchored in assembly 3. It should be noted that, in inclined wells where the anchoring of the sonde 25 or of connector 5 on assembly 3 is generally indispensable, the support 7 according to the embodiment of FIG. 4A can be anchored without the preponderant action of gravity. The section just has to be tightened so as to lengthen it by a length greater than H, the body can thereafter be unlocked from the shaft before loosening the tension so as to bring support 7 into the state shown in FIG. 4B.

In the state shown in FIG. 4B, the relative displacement of length H between the shaft and the body makes expansion means 41 co-operate with the anchoring wedges. The conical shape of the expansion means makes the wedges pivot round axes 40 until they lean against the wall of the line. The displacement force such as described above holds up the anchoring of support 7 in the line. The outer shape and the pivoting angle of the wedges allow the support to be anchored on sections of the line of different diameters. In fact, the tubulars used, drillpipes, casing, tubing, etc, often exhibit variations in the inside diameter, notably at the connections. The present support may be anchored at any level in a line having inside diameter variations.

Cable 10 and the connector 9 thereof can be taken up just by breaking holding part 23 or by controlling the moving aside thereof. Of course, in the first case, the tensile strength of part 23 must be lower than the disanchoring force of said support. This force being at least equal to that designated above as displacement force.

Disuniting or disanchoring the support is achieved by lowering again cable 10 and the connector 9 thereof equipped with a part 23 with a tensile strength higher than the anchoring force. This strength should also be higher than the force necessary for disanchoring section 6 from assembly 3, in case the latter is not remote controlled. If the holding part can be moved aside by remote control, this maneuvering of cable 10 can be avoided.

Without departing from the scope of this invention, the supports according to the embodiments of FIGS. 3 and 4A comprise electronic means which can be lifted with said supports notably for amplifying or for helping in the transmission of information between sonde 25 or assembly 3 and the surface. These electronic means may be located at the upper end of said section 6 or at the lower end of cable 10.

Be it in the case of principle 1 or 2, support 7 is possibly adapted for holding section 6 substantially taut, the connection of connectors 4 and 5 being locked notably according to the same principle described in FIG. 3 for connectors 8 and 9.

Within the scope of this invention, it is possible to completely clear the inside of the drill string of all the coaxial elements. In fact, whether the embodiment of FIG. 3 or of FIG. 4 is used, by remote control and/or by traction on cable 10, support 7 is disunited from the inside of the drill string, then connectors 4 and 5 are disconnected before all the cables are taken up by means of winch 11.

It is also possible to take up cable 10 and the connector 9 thereof before lowering a fishing tool adapted for fastening onto device 24 or 22, said device 24 also equipping the embodiment according to FIG. 4A or 4B but not shown here. The fishing string disanchors support 7 so as to pull it out of the hole with section 6 after disconnecting connectors 4 and 5. Using such a fishing string can allow higher mechanical stresses, notably tensile stresses. Before disconnecting connectors 8 and 9, the locking of the connection between connectors 4 and 5 can be controlled.

In this invention, it will be possible to replace the function of connection and of electric link provided by connector 9 and cable 10 by using cabled pipes as described in document FR-2,607,975. The lower end of a first cabled pipe is adapted for connecting electrically to the first intermediate connector 8 and mechanically to the upper end of the drill string or of the thread 17 of sub 15 if there is any. The cabled pipes will just have to be assembled to one another for operations to be carried on. The assembling connects both mechanically and electrically the drill string to the bottom. At the surface, the last cabled pipe is connected to a swivel adapted for linking the conductors of the last pipe to control cab 12 by means of a rotary electric joint having the same axis as the pipe. Said swivel may top a cabled kelly or be motorized.

The latter lay-out allows to turn the whole of the drill string and to bring additions without having to take up any electric cable length.

Of course, this solution may be mixed by using cable 10 notably by utilizing above cabled pipes an adapter comprising an intermediate connector similar to the first intermediate connector 8. Linking is achieved with this connector according to the present invention. The known cabled pipes leave the inner passageway free, it will therefore be possible to take up said section through these pipes by using a fishing tool passing through the cabled pipes and an adapted support 7.

Figure 5:
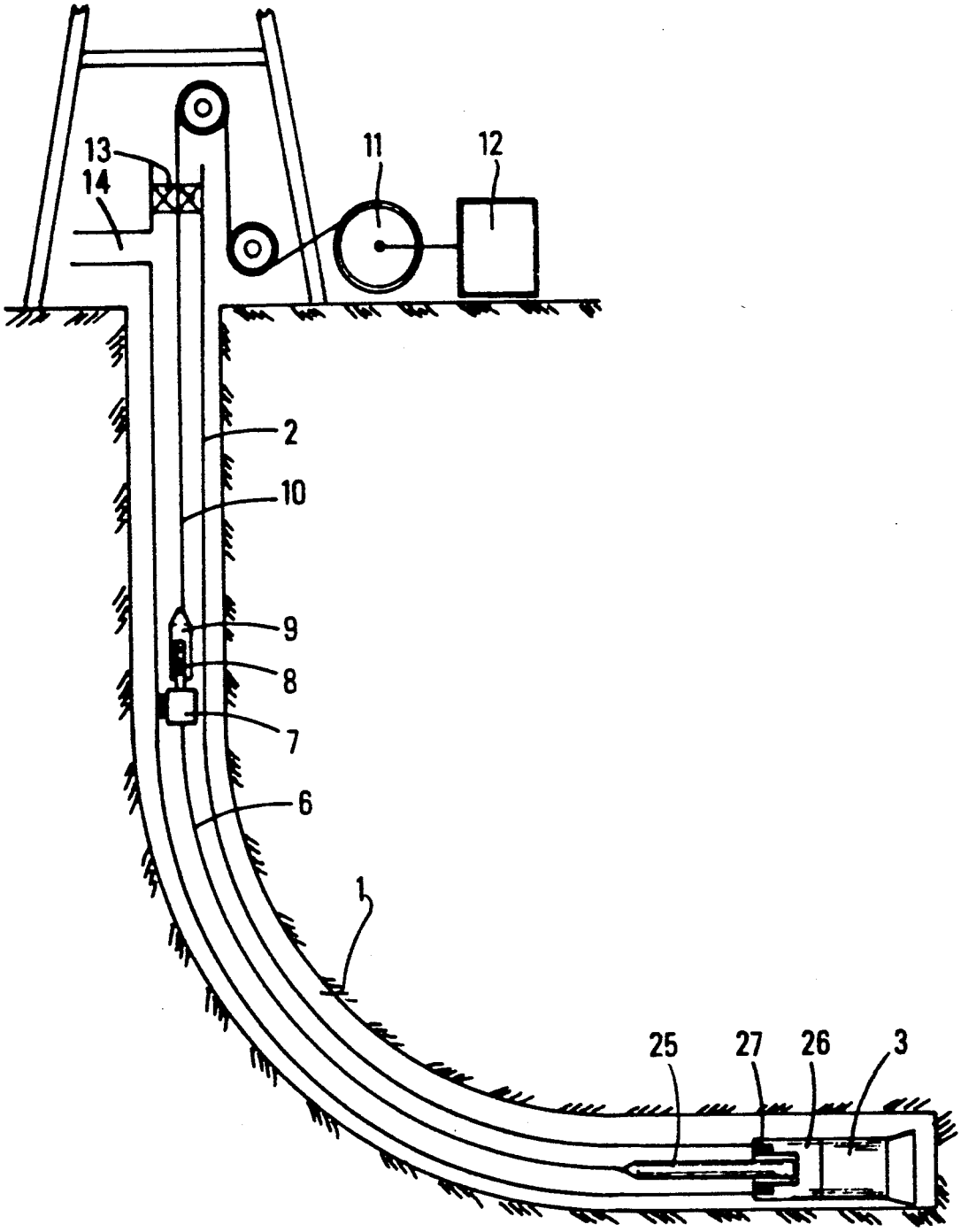
FIG. 5 shows a variant of the invention.

A variant of the present application relates to the configuration of FIG. 5, where a measuring and/or servicing sonde 25 is fastened to the lower end of section 6. The end of this sonde co-operates with a sub 26 of assembly 3. Assembly 3 may correspond to that of the previous embodiment but it preferably comprises no measuring and/or servicing means. Sub 26 comprises a mechanical anchoring 27 of sonde 25, possibly a system of the mule shoe type with an angular orientation of said sonde.

In another variant, sub 26 also comprises a first connector 4 electrically connected to measuring and/or servicing means of said assembly, in this case sonde 25 will comprise a second connector 5 at the end thereof.

In these variants, only what is located at the end of the cable section is different from the first embodiment, so all the previous description concerning the setting of section 6, the bonding of support 7, the methods of connection for connectors 4 and 5 and intermediate connectors 8 and 9, the use of cabled pipes, the partial or complete removal of the electric connections, is totally adapted to this variant. The lowering of sonde 25 is achieved in the same way as for connector 5, that is by gravity or by pumping.

Of course, sonde 25 is adapted for passing through the channel of the drill string, possibly of the cabled pipes and sub 15 if any.

Sonde 25 may comprise a slide and load bar system facilitating the adjustment of length of cable section 6.

In all the variants, cable 10 can pass through a side-entry sub and go up to the surface through the well-drill string annulus. This use is particularly interesting in cases where operations do not or not any longer require a possible rotation of the whole of the drill string.

Of course, the electric connection may consist of several sections identical to that referenced 6 and described above without departing from the scope of this invention. In fact, the total device and method are equivalent, be there one or several sections.

We claim:

1. A method for carrying out measurings and/or servicings in a wellbore or in a well in the process of being drilled, comprising the following stages:

a) fastening to the end of a first pipe of a drill string, an assembly comprising measuring and/or servicing means, said means being electrically linked to a first electric connector integral with said assembly and accessible from the inside of a drill string, b) assembling the drill string by connecting end to end new drillpipes above said first pipe and lowering progressively into the well said assembly and the drill string as the drill string is assembled, c) introducing into said drill string, from the surface, a second electric connector adapted for connecting to the first connector, this second connector being mechanically fastened to the lower end of a cable section of non zero length comprising electric conductors and whose other end is fastened to a support adapted for being integral with said drill string and comprising a first intermediate electric connector, d) introducing into said drill string, from the surface, a second intermediate electric connector adapted for connecting to said first intermediate connector, this second intermediate electric connector being mechanically fastened to the lower end of a cable comprising electric conductors and electrically connected to the surface, e) connecting said second connector to the first connector, f) making said support of the first intermediate connector integral with said drill string, g) connecting said second intermediate connector to the first intermediate connector, h) carrying out the measurings and/or the servicing, i) disconnecting the second intermediate connector and taking it up to the surface by means of cable.

2. A method as claimed in claim 1, wherein stage a), then b) are performed until the length of the drill string corresponds substantially to the length of said section and wherein stages c), e) and f) are performed thereafter, said support being located substantially at the surface.

3. A method as claimed in claim 1, wherein stages a), b), c) and g) are performed successively, the latter stage being achieved at the surface, then stage d) with said cable section connected to said cable through said intermediate connectors, stage e) and stage f).

4. A method as claimed in any one of the previous claims, wherein said support holds said section substantially taut.

5. A method as claimed in claim 1, wherein said section is taken up to the surface through said drill string either by using said section cable, or by means of a fishing tool adapted for connecting to the upper end of said section.

6. A method as claimed in claim 5, wherein the second intermediate connector and the cable are introduced into the drill string through a special side-entry sub.

7. A method as claimed in claim 5, wherein said assembly comprises directional drilling means, including a drill bit, a downhole motor, deflecting tools, and location sensors, and wherein the location parameters of the assembly are received and said drilling means are controlled by means of the electric connection from the surface.

8. A device for carrying out measurings and/or servicings in a wellbore or a well in the process of being drilled, comprising in combination:

an assembly fastened to a first pipe and comprising measuring and/or servicing means, a first electrical connector integral with said assembly and accessible from the inside of a drill string, said connector being electrically connected to said measuring and/or servicing means, said drill string connecting to the upper part of said first pipe, a cable section of non zero length comprising electric conductors, a second connector at the lower end thereof adapted for connecting to said first connector and a first intermediate connector at the other end thereof, said first intermediate connector being accessible from the inside of the drill string, a support of said intermediate connector adapted to be integral with said drill string, and a cable extending up to the surface, comprising electric conductors and at the end of which a second intermediate connector adapted for connecting to the first intermediate connector.

9. A device as claimed in claim 8, wherein said support is adapted for being made integral with said drill string when it is located substantially at the surface.

10. A device as claimed in claim 8, wherein said support is adapted for being made integral with said drill string by remote control from the surface.

11. A device as claimed in any one of claims 8 to 10, wherein said support is adapted for holding said section substantially taut and wherein the second connectors are anchored mechanically on the first connectors.

12. A device as claimed in claim 8, wherein at least one of said second connectors is equipped with load bars and/or with a system adapted for pumping so as to allow respectively the connection by gravity or by pumping of the second connector to the first connector.

13. A device as claimed in claim 8, wherein the outlet of cable from the inside of the drill string comprises a sealing means around the cable adapted for letting said cable slide into the drill string.

14. A device as claimed in claim 8, wherein said cable passes through a side-entry sub and comes out outside the drill string.

15. A device as claimed in claim 8, wherein said section is adapted for being taken up to the surface either through said cable connected by the second intermediate connector, or by a fishing tool adapted for connecting to the upper end of said section.

16. A device as claimed in claim 8, wherein said assembly comprises a drill bit, a downhole motor, deflecting tools, location sensors and wherein the possible measurings and servicings pass through the electric connection.

17. A method as claimed in claim 1, wherein recording of measurements and/or selective servicings is effected in an oil well, with a possibility of rotating said assembly and the drill string between each measuring and/or servicing.

* * * * *